United States Patent [19]

DeFranco et al.

[11] 4,299,016

[45] Nov. 10, 1981

[54] CATHODE RAY TUBE NECK CLEANSING-SCAVENGING MEANS AND METHOD

[75] Inventors: Thomas P. DeFranco, Norridge; Armando V. Marino, Chicago, both of Ill.

[73] Assignee: Zenith Radio Corporation, Glenview, Ill.

[21] Appl. No.: 99,460

[22] Filed: Dec. 3, 1979

[51] Int. Cl.[3] ..... H01J 9/38

[52] U.S. Cl. ..... 29/25.11; 29/25.2

[58] Field of Search ..... 29/25.11, 25.2, DIG. 7, 29/DIG. 98; 15/67, 68, 104.9; 316/17

[56] References Cited

U.S. PATENT DOCUMENTS

| | | | |
|---|---|---|---|
| 1,046,470 | 12/1912 | Laible | 15/104.9 |
| 2,296,801 | 9/1942 | Thomas | 15/67 |
| 2,308,350 | 1/1943 | Blackburn | 316/17 |
| 3,604,081 | 9/1971 | Moegenbier | 29/25.11 |

*Primary Examiner*—John McQuade

*Attorney, Agent, or Firm*—Ralph E. Clarke, Jr.

[57] ABSTRACT

Cleansing-scavenging means and method are disclosed for removing detritus from the inner surface of the neck of a cathode ray tube during manufacture. The means comprises probe means for insertion into the neck, and scrubbing means extending from the probe means for dislodging detritus. An expansible and contractible scavenging member is attached to a first end of the probe means. The member has a peripheral surface conformable to the inner surface of the neck for exerting, when expanded, outward scavenging pressure against the inner surface of the neck. Handle means are attached to the second end of the probe means for manipulating the probe means, with associated means providing for expanding and contracting the scavenging member. After the detritus is dislodged from the inner surface of the neck by the scrubbing means, and as the probe means is withdrawn from the neck, the scavenging member when expanded scavenges the detritus from the neck.

8 Claims, 6 Drawing Figures

CATHODE RAY TUBE NECK CLEANSING-SCAVENGING MEANS AND METHOD

BACKGROUND OF THE INVENTION

This invention is related to cathode ray tubes, and is particularly concerned with method and means for cleansing cathode ray tubes during manufacture.

The manufacturing environment wherein the unsealed cathode ray tube envelopes are processed is commonly replete with contaminants, specifically particulate matter meeting the definition of "detritus." The contaminants are primarily those directly associated with cathode ray tube manufacture, such as particles of metal and metal oxides abraded from the shadow mask and the attaching members, particles of graphite dislodged from the conductive coating deposited on the inner surface of the funnel, particles of aluminum and of the lacquer used in the aluminizing process, and particles of phosphor from the imaging screen. The particles may range in size from one micron to several hundred microns.

Much effort has been directed to the cleansing of the interior of cathode ray tube envelopes during manufacture to rid CRT interiors of such contaminants. The neck of the tube is particularly critical area in that it encloses the electron gun, or guns in plural-beam tubes. If the inner surface of the neck is not immaculately clean, particulate matter present in the neck area can migrate to the gun and lodge between the electrodes to become a point source for the initiation of inter-electrode arcing. When present between the neck wall and the gun, particles can create a path for arcing between the gun and the neck; the resulting arc can be so severe as to crack the neck or vaporize gun parts. Further, particulate matter can attain a high velocity under the urging of electromagnetic fields adjacent to the gun and bombard sensitive gun parts such as the cathodes, resulting in cathode failure. Certain chemical particulates can, upon lodgement on a cathode, poison it and cause its early failure as an emitter of electrons.

So it is imperative that the cathode ray tube interior, and particularly the area within the neck, be thoroughly cleaned.

It is common in the manufacturing process to attempt to clean the cathode ray tube neck by "dipping," wherein the neck section is immersed in an ultrasonically vibrated cleaning solution, after which the tube is drip-dried. This means has proved only marginally adequate. Another means in common use is the use of an "auger," wherein a tool resembling a revolving bottle brush is inserted into the neck. Many of the particles dislodged by this means are pushed up further into the neck by the auger, and end up in a ring near the intersection of the neck and the funnel of the envelope. Sooner or later during the operating life of the tube, particles in the ring will be dislodged by shock or vibration or by electromagnetic forces, and become migrant to the detriment of tube operation.

OBJECTS OF THE INVENTION

It is a general object of this invention to provide for improved performance of cathode ray tubes.

It is a less general object of the invention to provide improved means and method for cleansing the inner surface of the necks of cathode ray tubes.

It is a more specific object of the invention to provide cleansing means and method for cathode ray tube necks that will reduce cost and time required for production.

It is a specific object of this invention to provide means and method for cleansing cathode ray tube necks that will reduce to a practical minimum the number of particles remaining in the neck.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENTS

Figure 1:
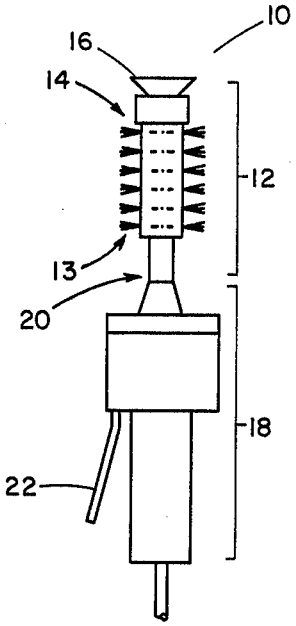
FIG. 1 is a view in elevation of a cleansing-scavenging means according to the invention.

FIG. 1 depicts means according to the invention for cleaning and scavenging detritus from the inner surface of the neck of a cathode ray tube having a glass envelope. The means and method according to the principles of the invention are designed for use in the manufacture of cathode ray tubes, especially television picture tubes.

The cleansing-scavenging means 10 according to the invention comprises, essentially, probe means 12 for insertion into the cathode ray tube and including scrubbing means 13 for dislodging detritus from the inner surface of a cathode ray tube neck. Probe means 12 has at a first end 14 an expansible and contractible "scavenging member" 16 including a peripheral surface comformable to the inner surface of the neck for exerting, when expanded, outward scavenging pressure against the inner surface. Handle means 18 are attached to the second end 20 of probe means 12 for manipulating probe means 12. Handle means 18 has associated means for expanding and contracting the scavenging means 16; the associated means are shown in this embodiment of the invention as comprising lever means 22.

Figure 2A:
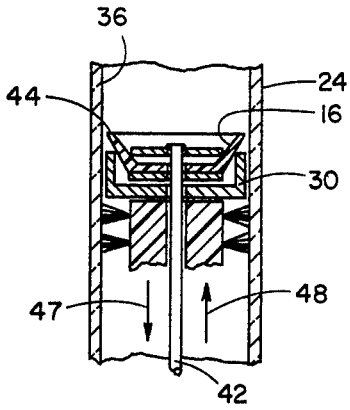
FIG. 2A is an enlarged view of a section of FIG. 2 depicting additional structural details.
Figure 2:
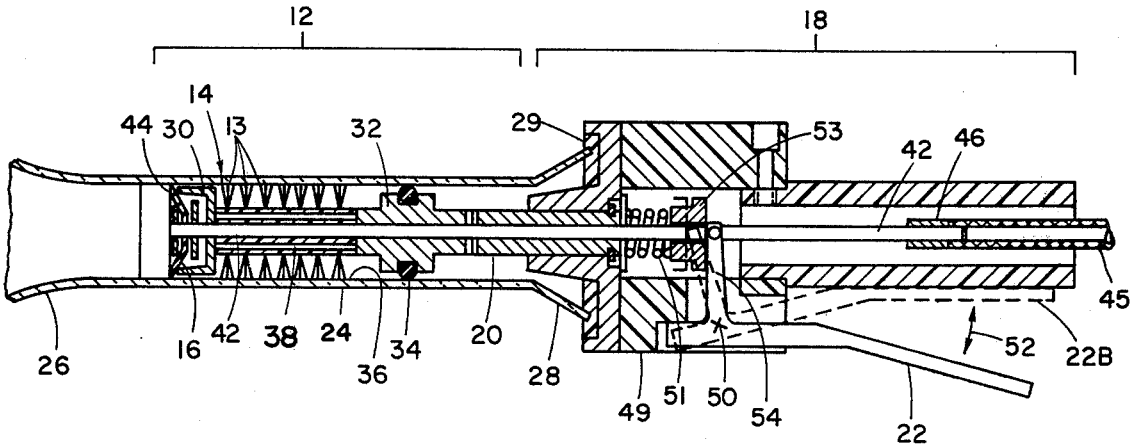
FIG. 2 is a view in elevation and partially in section showing structural details of a preferred embodiment of the invention.

FIG. 2 shows in partial section a preferred embodiment of the cleansing-scavenging means 10 according to the invention. It is to be recognized that the implementation of the invention is not restricted to the embodiment shown, and that alternate means to implement the invention according to its principles will occur to those skilled in the art. Exemplary alternate means are suggested in conjunction with the following description.

In FIG. 2, the first end 14 of probe means 12 is shown as being inserted into a neck 24 of a cathode ray tube, the entirety of which is not shown. Cathode ray tube funnel 26, a fragment of which is depicted, is indicated as flaring out from neck 24. At the opposite end of the neck 24 is another flared section 28 which is temporary only, and which is provided to facilitate installation of the electron gun into the neck 24 during manufacture. Temporary section 28 is cut from neck 24 when it is no longer required. An elastomeric pad 29 is provided for the shock-proof seating of flared section 28 upon insertion of probe means 12 into neck 24.

Probe means 12 is shown in this embodiment as having cup-shaped forward centering means 30 and aft centering means 32. Aft centering means 32 is depicted as having projecting from it an elastomeric annular ring 34 for making relatively friction-free sliding contact with the inner surface 36 of neck 24. The annular ring 34 may comprise a O-ring-type material such as Neoprene.

Scrubbing means 13 are depicted as comprising ranks of bristles for making scrubbing contact with the inner surface 36 of neck 24. The bristles may be made of nylon, which has been shown to be effective in this application; however, other well-known materials commonly used in scrubbing applications may as well be used.

Probe means 12 also includes a rotatable first shaft means 38 for rotating scrubbing means 13 to dislodge detritus from the inner surface 36. Probe means 12 includes expansible and contractible scavenging member 16 noted as being located at the first end 14 of probe means 12.

In this embodiment of the invention, scavenging member 16 is depicted as being comprised of a cup mounted on a second shaft 42 concentric with, an axially movable with respect to, rotatable first shaft means 38. Scavenging member 16, designated as a "first cup," has a peripheral surface 44 conformal, when expanded, to the inner surface 36 of neck 24 for exerting outward scavenging pressure against inner surface 36. For compressibility and flexibility of scavenging member 16, the member is preferably comprised of an elastomeric material such as a rubber. In FIG. 2, scavenging member 16 is shown as being expanded and exerting outward scavenging pressure against the inner surface 36. As shown by FIG. 2A, scavenging member 16 the "first" cup is contracted by nesting into an adjacent, smaller second cup formed by forward centering means 30, which is attached to first shaft 38. As a result of this nesting, the peripheral surface 44 of scavenging member 16 is out of contact with inner surface 36 of neck 24. Conversely, as shown by FIG. 2, scavenging member 16 is expanded and peripheral surface 44 is in contact with inner surface 36 as a result of "de-nesting" from the second cup formed by forward centering means 30.

Expansible scavenging member 16 is caused to nest or to de-nest by the axial movement of shaft 42, as indicated by arrows 47 and 48. The axial movement of shaft 42 in either direction is in consequence of the depressing or the releasing of lever means 22 which projects from lever housing 49, and extends rearwardly over handle means 18, as shown. In the embodiment of the invention shown and described, the actuation of lever means 22 is manually. Lever means 22 is indicated as being pivoted at pivot point 50 in lever housing 49; the excursion of lever means 22 toward and away from handle means 18 by manipulative pressure is indicated by the associated dash-line configuration 22B and associated arrow 52. The arm 54 extending from lever means 22 may have at its distal end a fork which makes engagement with a collar 53 attached to shaft 42, or, a fork engaging a groove in shaft 42 to provide for axial movement of shaft 42 when lever 22 is depressed, mechanical devices well known in the art. A spring 51 provides for the return of shaft 42 after release of the pressure applied by lever means 22. Rotating first shaft 38 is caused to rotate by second shaft 42 through a standard spline connection (not shown). The spline also allows for axial movement of second shaft 42 in response to the movement of lever means 22.

Alternately, and within the purview of this invention, the axial movement of second shaft 42 as it rotates can be well be accomplished by a pneumatic cylinder located adjacent to shaft 42 in lieu of a manually operated lever 22. The piston of the cylinder may be linked to shaft 42 by the aforedescribed fork-and-groove or fork-and-disc combination. The pneumatic cylinder could be activated by a valve actuated by a push-button.

The method for cleaning detritus from the inner surface 36 of neck 24 according to the invention comprises the contracting of scavenging member 16 before the insertion of probe means 12 into neck 24. Scrubbing means 13 is activated to scrub detritus from inner surface 36. Activating of the scrubbing means comprises, in the configuration described as exemplary, the initiation of the rotation of second shaft 42 which causes the bristles of scrubbing means 13 to exert a scrubbing action on the inner surface 36 of neck 24. Expansible scavenging member 16 is caused to expand by depressing lever means 22. Probe means 12 is then redrawn from neck 24 while the bristles of scrubbing means 13 are rotating, and as scavenging member 18 is expanded. As a result, the detritus removed by scrubbing means 13 is removed from neck 24 as expansible scavenging member 16 is withdrawn.

Figure 3:
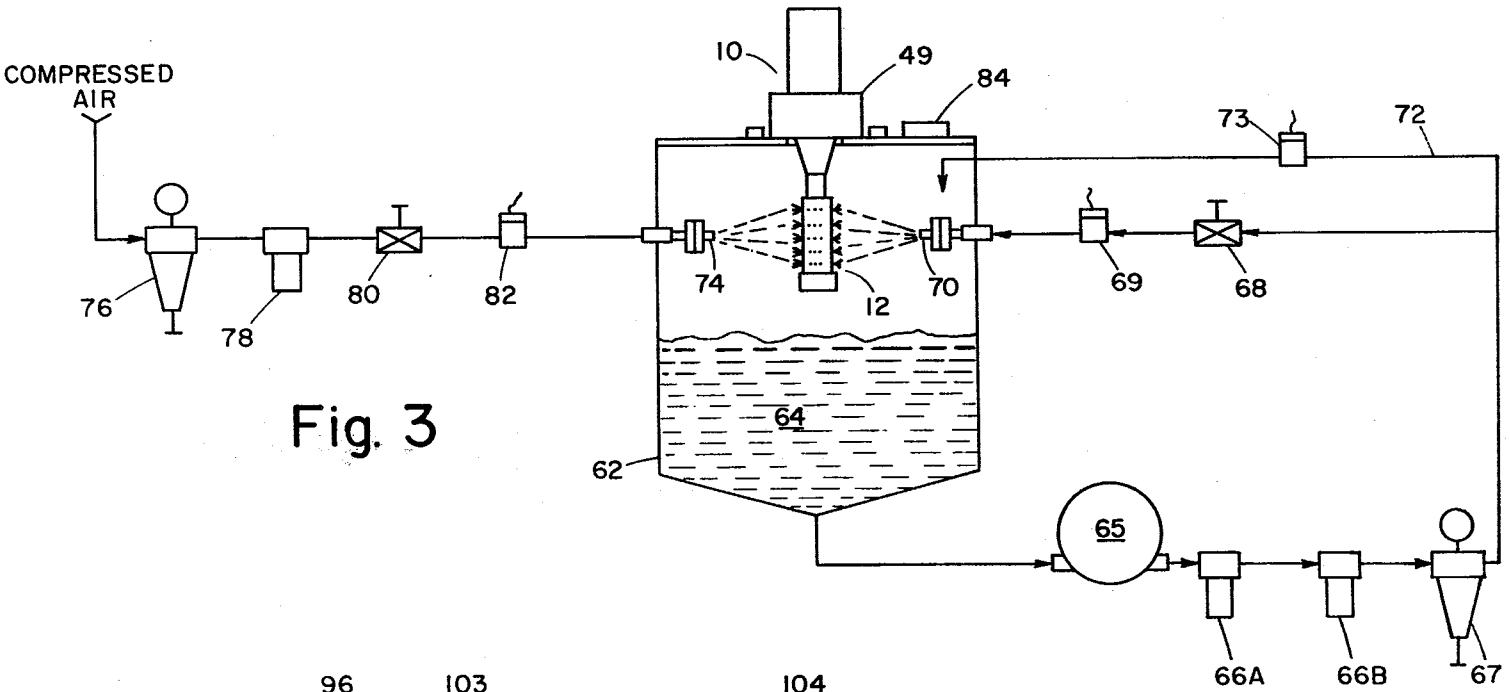
FIG. 3 is a schematic diagram, partially pictorial, showing means for purging particulate matter from the embodiment depicted by FIGS. 1 and 2.

To prevent re-contamination of the neck of the cathode ray tube by the re-insertion of probe means 12 with detritus adherent thereto, it is desirable to purge probe means 12 after each use. Purging can be accomplished by the exemplary means shown in schematic form by FIG. 3, wherein probe means 12 and attaching parts are shown as being inserted into a partially filled fluid reservoir 62 containing a cleansing fluid 64 such as, for example, deionized water. Cleansing fluid 64 is shown as being circulated by a high pressure pump 65 through a two-stage filter system comprising successively, for example, as 10 micron pre-filter element 66A and a one micron final filter element 66B. A pressure regulator and gauge 67 provides for a line pressure of 50–60 pounds per square inch. The cleansing fluid passes through flow control valve 68 and a normally closed solenoid shut-off valve 69, then is ejected by spray head 70 against probe means 12, as depicted. The spraying cycle is preferably four to six seconds in duration as shaft 38 rotates. An alternate path 72 is provided for discharge of the cleansing fluid 64 during intervals when no spray is required. The desired path is provided by alternate activation by programming means of the normally closed solenoid valve 69 and normally open solenoid valve 73.

Following the spraying cycle, the cleansing fluid is blown off probe 12 by a four to six second blast of air at a pressure of, for example, 30 to 40 pounds per square inch from nozzle 74. The pressure of the compressed air supply is adjusted by pressure regulator and gauge 76. A coalescent filter 78 removes contaminants, particularly oil, from the air. The air supply is controlled by a flow control valve 80 and normally closed solenoid valve 82. At the completion of the purging cycle, the detritus that has adhered to probe means 12 is almost completely removed. As a result, when probe means 12 is re-inserted into the neck of a cathode ray tube, it carries almost no particulate matter with it.

The purging cycle can be initiated by a microswitch 84 which closes upon contact with lever housing 49. The cycling can be controlled by a simple programmer (not shown), examples of which are well known in the art. Spray nozzle 70 can be that supplied by Spraying Systems Company of Wheaton, Illinois under the designation Flat Spray Tip number 5005, type 1/4TT, or an equivalent. The air nozzle can be that supplied by the same firm under the designation of 1/4TT Blow-Off Nozzle, or an equivalent.

Neck scrubbing means 13 is depicted in the example shown by FIGS. 1—4 as being bristle means rotated to exert a scrubbing action. In lieu of a rotating component, the scrubbing means could as well comprise a scrubbing member comprising bristles vibrating in the direction of the longitudinal axis of the neck, for example. Other scrubbing means according to the principles of the invention will readily suggest themselves to those skilled in the art.

Figure 4:
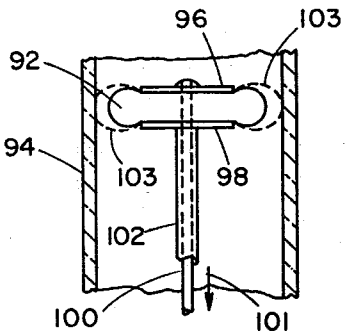
FIGS. 4 and 5 are schematic views in elevation and partially in section of alternate embodiments of a scavenging member according to the principles of the invention.

Expansible scavenging member 16 is depicted and described in the foregoing as being in the form of a cup. Expansible scavenging member 16 according to the invention is not limited to a cup configuration. but as shown by FIG. 4, the member could as well be an elastomeric member in the form of a toroid 92. Toroid 92 is depicted as being confined between two compression members 96 and 98. Compression member 96 is fixed to an inner shaft 100, while compression member 98 is fixed to a concentric outer shaft 102. Movement of the concentric inner shaft 100 in an axial direction inwardly as indicated by the associated arrow 101, results in the compression of toroid 92 in the direction of the longitudinal axis of neck 24, causing it to assume expanded configuration 103 and exert outward scavenging pressure against the inner surface of neck 94, with the area of contact as indicated by the dash lines.

Figure 5:
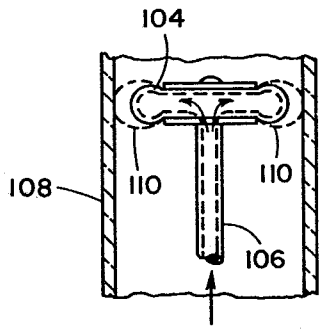

Another embodiment of the expansible scavenging member according to the principles of the invention is depicted in FIG. 5, wherein the member is in the form of a tire 104 which may also be made of an elastomer. Compressed air, controlled by a suitable valve (not shown) is introduced into the tire through a hollow inner shaft 106, as indicated by the associated arrows. The introduction of air into tire 104 causes it to expand and assume a configuration 110 that exerts outward scavenging pressure against the inner surface of neck 108, with the area of contact as indicated by the dash lines.

A material suitable for fabrication of the cleansing-scavenging means according to the invention may, for example, comprise nylon for the handle means 18 and for the lever housing 49. The rotatable member 38, aft centering means 32, and the forward centering means 30 may also be nylon, as well as attaching parts such as screws that are not subject to excessive stress. The criterion in selecting a suitable material is whether or not it is resistant to the oxidizing effects of water and other chemicals endemic to the production environment.

The expansible scavenging member, whether in the preferred form of the cup, or in the form of a toroid or tire, may be fabricated from cis-polybutadiene or cis-polyisoprene, elastomers which closely duplicate the properties of natural rubber. The newer ethylene-propylene rubbers are also suitable because of their excellent resistance to heat and oxidation.

Lever means 22, shaft 42, and spring 51 are preferably made of stainless steel for corrosion resistance. The nylon comprising handle means 18 and lever housing 49 can be bored to provide fully supportive bearings for rotating shaft 42, as the rate of rotation is a nominal 100 to 150 revolutions per minute, and the load itself is nominal.

Second shaft 42 (and associated scrubber means 13) can be caused to rotate by a flexible shaft 45, a fragment of which is shown. Shaft 45 is attached to motor means (not shown). Shaft 45 can be coupled to second shaft 42 by a mechanical coupler 46, as shown. A motor means can be selected from a group consisting of electric, pneumatic and hydraulic.

Approximate dimensions in inches of the components may be, for example:

Overall length: 10
Probe means (12): 4.5
Lever housing (49): 2
Handle means (18): 3.25, and
Lever means (22): 2.8

The diameter of the peripheral path of the bristles of scrubbing means 13 is preferably about 1.2 inch when used to scrub a neck having a minimum inside diameter of about 0.950 inch.

A typical cleansing-scavenging cycle is three to six seconds for cleansing; that is scrubbing and scavenging, and eight to twelve seconds for the purge.

Tests showed that the efficacy of the cleansing-scavenging means and method according to the invention is such that the number of particles remaining in the neck were of the order of 10 to 12 times fewer than that provided by prior art cleansing means. This low particle count represents, for all practical purposes, an irreducible minimum.

Well-known manufacturing tools and fixtures such as conveyors, tool positioners and work-piece aligners can be termed with a suitable numeric control programmer to provide for automation of the neck cleansing-scavenging and purging according to the invention. The expansion and contraction of scavenging member 16, described as being operated manually, could as well be accomplished by an associated pneumatic cylinder activated by the programmer. These and other expedients providing for fully automatic operation will readily occur to those skilled in the art.

Types of materials, dimensions, time sequences and other values presented in the foregoing description are merely by way of illustration and in no way limiting. While particular embodiments of the invention have been shown and described, it will be obvious to those skilled in the art that changes and modifications may be made without departing from the invention in its broader aspects, and therefore, the aim of the appended claims is to cover all such changes and modifications as fall within the true spirit and scope of the invention.

We claim:

1. For use in the manufacture of a cathode ray tube having a glass envelope including a neck for enclosing an electron gun, cleansing-scavenging means for removing detritus from the inner surface of said neck before the installation of said gun comprising:

probe means for insertion into said neck including scrubbing means for dislodging detritus and having at a first end thereof an expansible and contractible scavenging member including a peripheral surface comformable to said inner surface of said neck for exerting, when expanded, outward scavenging pressure against said inner surface;

handle means attached to the second end of said probe means for manipulating said probe means and having associated means for expanding and contracting said scavenging member;

such that after the detritus is dislodged from said inner surface of said neck by said scrubbing means, and as said probe means is withdrawn from said neck, said scavenging member when expanded scavenges the detritus from said neck.

2. The cleansing-scavenging means according to claim 1 wherein said scavenging member comprises an elastomeric first cup contractible by nesting into an adjacent smaller second cup, and expansible by de-nesting from said second cup.

3. The cleansing-scavenging means according to claim 1 wherein said scavenging member comprises an elastomeric toroid which expands when compressed in the direction of the longitudinal axis of said neck, and contracts when uncompressed.

4. The cleansing-scavenging means according to claim 1 wherein said scavenging member comprises an elastomeric tire which expands when inflated and contracts when deflated.

5. For use in the manufacture of the cathode ray tube having a glass envelope including a neck for enclosing an electron gun, cleansing-scavenging means for removing detritus from the inner surface of said neck before the installation of said gun comprising:

probe means for insertion into said neck including scrubbing means for dislodging detritus and having at a first end an expansible and contractible scavenging member including a peripheral surface conformable to said inner surface of said neck for exerting, when expanded, outward scavenging pressure against said inner surface;

handle means attached to the second end of said probe means for manipulating said probe means and having associated means for expanding and contracting said scavenging means;

purging means for dislodging and removing the detritus from said probe means;

such after the detritus is dislodged from said inner surface by said scrubbing means, and as said probe is withdrawn from said neck, said scavenging member when expanded provides for scavenging the detritus from said inner surface, whereafter said purging means provides for purging the detritus from said probe.

6. For use in the manufacture of a cathode ray tube having a glass envelope including a neck for enclosing an electron gun, cleansing-scavenging means for removing detritus from the inner surface of said neck before installation of said gun comprising:

probe means for insertion into said neck having centering means for centering said probe means in said neck, bristle means for making scrubbing contact with said inner surface, rotatable first shaft means for rotating said bristle means and dislodging the detritus from said inner surface, said probe means including an expansible and contractible scavenging member located at a first end of said probe means, said scavenging member comprising an elastomeric first cup mounted on a second shaft concentric with, and axially movable with respect to, said first shaft means, said first cup having a peripheral surface conformal, when expanded, to said inner surface of said neck for exerting outward scavenging pressure against said inner surface, said first cup being contracted by nesting into an adjacent smaller second cup mounted on said first shaft means, and expanded by de-nesting from said second cup;

handle means attached to the second end of said probe means for manipulating said probe means, and including lever means linked to said second shaft for providing said axial movement of said shaft;

motor means for rotating said shaft means;

associated purging means including pressurized fluid and air spray means for removing detritus lodged on said probe means;

such that after the detritus is dislodged from said inner surface by said scrubbing means, and as said probe is withdrawn from said neck, said scavenging member, when expanded, provides for scavenging the detritus from said inner surface, whereafter said purging means provides for purging the detritus from said probe means.

7. For use in the manufacture of a cathode ray tube having a glass envelope with a neck extending therefrom for enclosing an electron gun, a method for cleansing detritus from the inner surface of said neck prior to the installation of said gun using a probe having activatable scrubbing means, and an expansible and contractible scavenging memeber at the distal end thereof for exerting, when expanded, outward scavenging pressure against said inner surface of said neck, the method comprising:

contracting said scavenging member;

inserting said probe into said neck;

activating said scrubbing means to scrub the detritus from said inner surface;

expanding said scavenging member;

withdrawing said probe from said neck;

such that the detritus removed by said scrubbing means is withdrawn from said neck by said scavenging member as said probe is withdrawn.

8. For use in the manufacture of a cathode ray tube having a glass envelope with a neck extending therefrom for enclosing an electron gun, a method for cleansing detritus from the inner surface of said neck prior to the installation of said gun using a probe having activatible neck-scrubbing means and an expansible and contractible scavenging member at the distal end for exerting when expanded appreciable outward conformal pressure against said inner surface of said neck, the method comprising:

contracting said scavenging member;

inserting said probe into said neck;

activating said neck-scrubbing means to scrub the detritus from said inner surface;

expanding said scavenging member;

withdrawing said probe from said neck such that the detritus removed by said neck-scrubbing means is withdrawn from said neck by said scavenging member; and purging by fluid and air spray means the detritus adhering to said neck scrubbing means and said scavenging means, such that after the detritus is dislodged from said inner surface by said scrubbing means, and as said probe is withdrawn from said neck, said scavenging member provides for scavenging the detritus from said inner surface, whereafter said purging means provides for purging the detritus from said probe means.

* * * * *